US008936236B2

(12) United States Patent
Nakano et al.

(10) Patent No.: US 8,936,236 B2
(45) Date of Patent: Jan. 20, 2015

(54) COIL SPRING FOR AUTOMOBILE SUSPENSION AND METHOD OF MANUFACTURING THE SAME

(75) Inventors: Tomohiro Nakano, Nagoya (JP); Takayuki Sakakibara, Nagoya (JP); Takanori Kuno, Nagoya (JP); Shingo Mimura, Nagoya (JP); Masami Wakita, Nagoya (JP)

(73) Assignee: Chuo Hatsujo Kabushiki Kaisha, Nagoya-Shi (JP)

( * ) Notice: Subject to any disclaimer, the term of this patent is extended or adjusted under 35 U.S.C. 154(b) by 919 days.

(21) Appl. No.: 12/892,434

(22) Filed: Sep. 28, 2010

(65) Prior Publication Data

US 2011/0074079 A1 Mar. 31, 2011

(30) Foreign Application Priority Data

| | | |
|---|---|---|
| Sep. 29, 2009 | (JP) | 2009-225422 |
| Sep. 29, 2009 | (JP) | 2009-225423 |
| Sep. 29, 2009 | (JP) | 2009-225424 |
| Jan. 19, 2010 | (JP) | 2010-009072 |

(51) Int. Cl.

| | |
|---|---|
| ***F16F 1/06*** | (2006.01) |
| ***C22C 38/34*** | (2006.01) |
| ***C22C 38/04*** | (2006.01) |
| ***C22C 38/42*** | (2006.01) |
| ***C22C 38/44*** | (2006.01) |

(Continued)

(52) U.S. Cl.

CPC ..... *C22C 38/34* (2013.01); *C22C 38/04* (2013.01); *C22C 38/42* (2013.01); *C22C 38/44* (2013.01); *C22C 38/50* (2013.01); *C22C 38/54* (2013.01)

USPC ..... 267/166; 29/896.91; 29/90.7

(58) Field of Classification Search

USPC ..... 267/155–157, 166; 148/580; 29/896.9, 29/896.91, 90.7; 72/53

See application file for complete search history.

(56) References Cited

U.S. PATENT DOCUMENTS

| | | | |
|---|---|---|---|
| 4,448,617 | A | 5/1984 | Yamamoto et al. |
| 4,544,406 | A | 10/1985 | Yamamoto et al. |

(Continued)

FOREIGN PATENT DOCUMENTS

| | | | | |
|---|---|---|---|---|
| JP | H01191745 | A | | 8/1989 |
| JP | 03037434 | A | * | 2/1991 |

(Continued)

OTHER PUBLICATIONS

Office Action mailed May 9, 2013 for U.S. Appl. No. 12/892,439, including lists of references cited and Examiner Search Notes.

(Continued)

*Primary Examiner* — Bradley King

(74) *Attorney, Agent, or Firm* — J-Tek Law PLLC; Jeffrey D. Tekanic; Scott T. Wakeman

(57) ABSTRACT

A manufacturing method of a coil spring for an automobile suspension includes forming a material into a coil shape; performing a heat treatment step on the material; performing a warm shot peening step on the material, and performing a hot setting step on the material. By performing the warm shot peening step prior to the hot setting step, a stronger compressive residual stress is imparted in a direction along which a large tensile stress acts during actual use of the coil spring, thereby improving sag resistance and durability of the coil spring. A coil spring is also manufactured according to this method.

21 Claims, 12 Drawing Sheets

(51) Int. Cl.
*C22C 38/50* (2006.01)
*C22C 38/54* (2006.01)

(56) References Cited

U.S. PATENT DOCUMENTS

| | | | | |
|---|---|---|---|---|
| 5,009,843 | A | 4/1991 | Sugimoto et al. | |
| 5,183,634 | A | 2/1993 | Abe et al. | |
| 5,225,008 | A | 7/1993 | Koyama et al. | |
| 5,258,082 | A | 11/1993 | Koyama et al. | |
| 5,286,312 | A | 2/1994 | Shimotsusa et al. | |
| 5,508,002 | A | 4/1996 | Kawaguchi et al. | |
| 5,575,973 | A * | 11/1996 | Choi et al. | 420/112 |
| 5,846,344 | A | 12/1998 | Kawaguchi et al. | |
| 5,863,358 | A | 1/1999 | Krzysztalowicz | |
| 5,897,717 | A | 4/1999 | Hashimura et al. | |
| 6,017,641 | A | 1/2000 | Aoki et al. | |
| 6,027,577 | A | 2/2000 | Mikura et al. | |
| 6,193,816 | B1 | 2/2001 | Nakano et al. | |
| 6,375,174 | B2 | 4/2002 | Hasegawa et al. | |
| 6,406,565 | B1 | 6/2002 | Hashimura et al. | |
| 6,543,757 | B2 | 4/2003 | Imaizumi | |
| 6,544,360 | B1 * | 4/2003 | Tange et al. | 148/580 |
| 6,550,301 | B2 | 4/2003 | Hasegawa | |
| 6,616,131 | B2 | 9/2003 | Imaizumi | |
| 6,648,996 | B2 | 11/2003 | Hasegawa | |
| 6,712,346 | B2 | 3/2004 | Imaizumi | |
| 6,779,564 | B2 | 8/2004 | Hasegawa et al. | |
| 6,836,964 | B2 | 1/2005 | Hasegawa et al. | |
| 7,407,555 | B2 | 8/2008 | Yoshikawa et al. | |
| 7,597,768 | B2 | 10/2009 | Suda et al. | |
| 7,615,186 | B2 | 11/2009 | Suda et al. | |
| 7,699,943 | B2 | 4/2010 | Nakano et al. | |
| 7,776,440 | B2 | 8/2010 | Kunita et al. | |
| 8,328,169 | B2 | 12/2012 | Kuno et al. | |
| 8,349,095 | B2 | 1/2013 | Nakano et al. | |
| 2005/0173028 | A1 | 8/2005 | Suda et al. | |
| 2006/0060269 | A1 | 3/2006 | Nakano et al. | |
| 2006/0169367 | A1 | 8/2006 | Yuse et al. | |
| 2006/0196584 | A1 | 9/2006 | Kochi et al. | |
| 2006/0201588 | A1 | 9/2006 | Suda et al. | |
| 2006/0225819 | A1 | 10/2006 | Yoshihara | |
| 2007/0163680 | A1 | 7/2007 | Suda et al. | |
| 2007/0256765 | A1 * | 11/2007 | Kimura et al. | 148/580 |
| 2007/0267112 | A1 * | 11/2007 | Yoshikawa et al. | 148/580 |
| 2008/0163957 | A1 | 7/2008 | Brady et al. | |
| 2008/0271824 | A1 | 11/2008 | Fujino et al. | |
| 2008/0308195 | A1 | 12/2008 | Yoshihara et al. | |
| 2009/0020189 | A1 | 1/2009 | Yoshihara et al. | |
| 2009/0020195 | A1 | 1/2009 | Kubota et al. | |
| 2009/0079246 | A1 | 3/2009 | Okura et al. | |
| 2009/0114318 | A1 | 5/2009 | Arai et al. | |
| 2009/0174129 | A1 | 7/2009 | Izumida et al. | |
| 2009/0205753 | A1 | 8/2009 | Hashimura et al. | |
| 2009/0283181 | A1 | 11/2009 | Suda et al. | |
| 2009/0293998 | A1 | 12/2009 | Fujino et al. | |
| 2010/0034691 | A1 | 2/2010 | Yoshihara | |
| 2010/0175795 | A1 | 7/2010 | Choi et al. | |
| 2010/0224287 | A1 | 9/2010 | Kochi et al. | |
| 2011/0074076 | A1 | 3/2011 | Kuno et al. | |
| 2011/0074077 | A1 | 3/2011 | Kuno et al. | |
| 2011/0074078 | A1 | 3/2011 | Nakano et al. | |
| 2011/0303327 | A1 | 12/2011 | Yoshihara et al. | |
| 2013/0008566 | A1 * | 1/2013 | Suzuki et al. | 148/226 |

FOREIGN PATENT DOCUMENTS

| | | | |
|---|---|---|---|
| JP | H0578785 | A | 3/1993 |
| JP | H05-195153 | A | 8/1993 |
| JP | 5-271879 | | 10/1993 |
| JP | H07-179985 | A | 7/1995 |
| JP | H07173577 | A | 7/1995 |
| JP | 7-292435 | A | 11/1995 |
| JP | H10287958 | A | 10/1998 |
| JP | H11241143 | A | 9/1999 |
| JP | 2000-282176 | | 10/2000 |
| JP | 2000326036 | A | 11/2000 |
| JP | 2001082518 | A | 3/2001 |
| JP | 2001-220650 | | 8/2001 |
| JP | 2003105498 | A | 4/2003 |
| JP | 2003-147479 | | 5/2003 |
| JP | 2005-29870 | A | 2/2005 |
| JP | 2006291291 | A | 10/2006 |
| JP | 2007063584 | A | 3/2007 |
| JP | 2007224413 | A | 9/2007 |
| JP | 2008133539 | A | 6/2008 |
| JP | 2008-261055 | | 10/2008 |
| WO | 2004085685 | A | 10/2004 |
| WO | 2006022009 | A | 3/2006 |
| WO | 2007114491 | A | 10/2007 |

OTHER PUBLICATIONS

Unpublished U.S. Appl. No. 13/978,321.
Office Action mailed Apr. 25, 2012 for U.S. Appl. No. 12/892,444.
Office Action mailed Apr. 25, 2012 for U.S. Appl. No. 12/892,445.
Amendment and Response to non-final Office Action mailed Apr. 25, 2012 for U.S. Appl. No. 12/892,445.
Amendment and Response to non-final Office Action mailed Apr. 25, 2012 for U.S. Appl. No. 12/892,444.
Excerpt from the textbook Spring, 4th edition edited by the Japan Society of Spring Engineers 2008, p. 508.
Office Action mailed Nov. 19, 2013 for counterpart (priority) Japanese patent application No. 2009-225422, including English translation of prior art rejections.
Final Office Action mailed Nov. 16, 2013 for related U.S. Appl. No. 12/892,439.
Office Action from the Japanese Patent Office mailed Dec. 11, 2013 in counterpart JP application No. 2010-009072, including English translation of prior art rejection.
Office Action from the Japanese Patent Office mailed Dec. 17, 2013 in counterpart JP application No. 2010-009072, including English translation of prior art rejection.
Final Office Action from the Japanese Patent Office mailed Mar. 4, 2014 in counterpart (priority) JP application No. 2010-009072, including English translation of prior art rejection.
Office Action from the Japanese Patent Office mailed Nov. 19, 2013 in related JP application No. 2009-225423, including English translation of prior art rejections.
Office Action from the Japanese Patent Office mailed Nov. 19, 2013 in related JP application No. 2009-225424, including English translation of prior art rejections.

* cited by examiner

FIG. 1A

| | New Method | Conventional Method | |
|---|---|---|---|
| Steel A | AN-sample | AC-sample | → Spec. : FIG. 1C |
| Steel B | BN-sample | BC-sample | → Spec. : FIG. 1D |

↓

Composition : FIG. 1B

FIG. 1B (mass%)

| Steel Type | C | Si | Mn | P | S | Ni | Cu | Cr | Mo | V | Ti | B |
|---|---|---|---|---|---|---|---|---|---|---|---|---|
| Steel A | 0.47 | 2.00 | 0.7 | 0.005 | 0.005 | 0.55 | 0 | 0.2 | 0 | 0.2 | 0 | 0 |
| Steel B | 0.47 | 2.18 | 0.44 | 0.007 | 0.006 | 0.53 | 0.01 | 0.29 | 0.09 | 0.1 | 0.023 | 0.0021 |

FIG. 1C

| Spring Shape | Wire Diameter (mm) | Mean Diameter of Coil (mm) | Free Length (mm) | Number of Effective Turns (Turns) | Spring Constant (N/mm) |
|---|---|---|---|---|---|
| Cylindrical | φ12.6 | φ162.6 | 318.5 | 3.12 | 24.0 |

FIG. 1D

| Spring Shape | Wire Diameter (mm) | Mean Diameter of Coil (mm) | Free Length (mm) | Number of Effective Turns (Turns) | Spring Constant (N/mm) |
|---|---|---|---|---|---|
| Cylindrical | $\phi$ 12.4 | $\phi$ 110.9 | 323.0 | 5.55 | 39.1 |

FIG. 2

| | Process Order | Amount of Sag (Residual Shear Strain x $10^{-4}$) | |
|---|---|---|---|
| AN-samples | SP→HS | 7.1 | 7.5 |
| AC-samples | HS→SP | 8.4 | 9.0 |

FIG. 3

| | Process Order | Endurance Cycles (10,000 Cycles) | |
|---|---|---|---|
| BN-samples | SP→HS | 22.3 | 24.7 |
| BC-samples | HS→SP | 13.5 | 11.2 |

FIG. 4

| | Process Order | Corrosion Endurance Cycles (10,000 Cycles) | |
|---|---|---|---|
| BN-samples | SP→HS | 4.5 | 5.2 |
| BC-samples | HS→SP | 3.5 | 4.0 |

FIG. 10

(135° +315° )/(45° +225° )

| | Surface | 0.1mm in Depth | 0.2mm in Depth | 0.3mm in Depth |
|---|---|---|---|---|
| BN-sample (SP→HS) | 1.665 | 1.138 | 1.125 | 1.185 |
| BC-sample (HS→SP) | 1.038 | 0.960 | 0.842 | 1.165 |

FIG. 11

| | Depth | | 0.0mm (Surface) | | | 0.1mm | | | 0.2mm | | |
|---|---|---|---|---|---|---|---|---|---|---|---|
| | Measure Direction | | Residual Stresses [MPa] | | Ratio | Residual Stresses [MPa] | | Ratio | Residual Stresses [MPa] | | Ratio |
| BN-sample 1 (SP→HS) | 135° | 315° | 607 | 648 | 0.97 | 1299 | 1333 | 0.95 | 1070 | 1063 | 1.18 |
| | 45° | 225° | 656 | 635 | | 1305 | 1447 | | 817 | 989 | |
| BN-sample 2 (SP→HS) | 135° | 315° | 668 | 644 | 1.10 | 1269 | 1342 | 0.94 | 1169 | 989 | 1.14 |
| | 45° | 225° | 649 | 648 | | 1323 | 1449 | | 945 | 961 | |
| BC-sample 1 (HS→SP) | 135° | 315° | 632 | 642 | 0.92 | 1097 | 1263 | 0.95 | 735 | 715 | 0.90 |
| | 45° | 225° | 712 | 679 | | 1197 | 1277 | | 779 | 837 | |
| BC-sample 2 (HS→SP) | 135° | 315° | 625 | 605 | 0.91 | 1202 | 1129 | 0.94 | 749 | 729 | 0.93 |
| | 45° | 225° | 673 | 693 | | 1234 | 1232 | | 758 | 835 | |

COIL SPRING FOR AUTOMOBILE SUSPENSION AND METHOD OF MANUFACTURING THE SAME

CROSS-REFERENCE TO RELATED APPLICATION

The present application claims priority to Japanese Patent Application Nos. 2009-225422, 2009-225423 and 2009-225424, all of which were filed on Sep. 29, 2009, and to Japanese Patent Application No. 2010-009072 filed on Jan. 19, 2010, the contents of all of which are hereby incorporated by reference into the present application.

TECHNICAL FIELD

The present application relates to a coil spring for an automobile suspension. The present application also relates to a method of manufacturing the same.

DESCRIPTION OF THE RELATED ART

A coil spring for an automobile suspension is typically made by shaping a steel wire or rod (hereinafter collectively "steel wire"). A conventional method for manufacturing such a coil spring is disclosed at page 508 of the textbook SPRING, $4^{th}$ edition edited by the Japan Society of Spring Engineers and includes the following steps:

1) The steel wire is formed into a coil shape;

2) the coil-shaped steel wire is subjected to a heat treatment (quenching and tempering);

3) the heat treated, coil-shaped steel wire is subjected to hot setting, wherein a compressive load that is larger than the maximum compressive load expected to be experienced by the coil spring during actual use is applied to the coil spring;

4) the coil spring is subjected to warm shot peening;

5) the coil spring is subjected to cold setting; and 6) the surface of the coil spring is provided with a protective coating.

SUMMARY

A coil spring has the property that the relationship between stress and strain changes during use. If this relationship changes or deteriorates quickly, the coil spring will quickly lose essential spring properties. In this specification, the property of maintaining the stress and strain relationship at a relatively constant level for a long period of time is referred to as "sag resistance". A coil spring is also subject to breakage due to repeated application of cyclical stresses. The property of having a long service-life until breakage is referred to herein as "durability".

The hot setting step during the manufacturing of the coil spring effectively increases the sag resistance of the manufactured coil spring, and the warm shot peening step effectively increases the durability of the coil spring.

A coil spring for an automobile suspension is required to have an extremely high level of sag resistance and durability. It is an object of the present teachings to provide a new method of manufacturing a coil spring that leads to an extremely high level of sag resistance and durability. The techniques disclosed herein also lead to a new and useful coil spring for an automobile suspension.

In the above-described conventional manufacturing method of the coil spring, the hot setting step is performed before the warm shot peening step. As a result of extensive and intensive studies, the inventors have discovered that this sequence of steps is disadvantageous for the following reason. The hot setting step imparts residual stress to the coil spring with a specific orientation, and this oriented residual stress improves sag resistance. However, the inventors have found that this desirable oriented residual stress generated by the hot setting step is weakened when the warm shot peening step is performed after the hot setting step.

Based on this discovery, the inventors have developed a new method in which the warm shot peening step is performed before the hot setting step. Extensive and intensive investigations have confirmed that a coil spring having the extremely high level of sag resistance and durability can be manufactured according to the new and improved method disclosed herein.

Although the inventors do not wish to be bound by theory, the following theory is offered as a possible reason for the improved properties of the coil springs produced according to the method disclosed herein:

1) The warm shot peening step imparts residual stress at the surface of the coil spring, which is compressive and isotropic. The surface compressive stress contributes to improving the durability of the coil spring.

2) The hot setting step imparts oriented residual stress to the coil spring, which contributes to improving the sag resistance of the coil spring. However, by performing the hot setting step after the warm shot peening step, the surface compressive stress generated by the warm shot peening step is not weakened.

3) The new method thus imparts a surface compressive stress generated by the warm shot peening step and an oriented residual stress generated by the hot setting step. Both the sag resistance and durability of the coil spring are improved.

In a manufacturing method disclosed herein, the warm shot peening step is performed before the hot setting step. Consequently, both the sag resistance and the durability of the coil spring are improved. In addition, a new and useful coil spring for automobile suspension can be manufactured. An explanation of particular improved properties will now be provided with the assistance of FIGS. 12 and 13.

FIG. 12A illustrates an upper portion of a coil spring. FIG. 12B illustrates an enlarged side view of the coil spring. The coil spring extends from an upper end 162 in a clockwise direction (i.e. a clockwise twist). Reference number 164 indicates a point on the surface of the coil spring. The point 164 is located at an outside position on the surface of the coil spring. Reference number 166 illustrates a virtual plane that contacts or intersects with the surface of the coil spring at the point 164. The directions for describing the orientation of the residual stress are defined as follows:

1) 0 degrees: 0 degrees is parallel with a direction along which the coil spring extends. 0 degrees extends from the point 164 toward the upper end 162.

2) θ degrees: θ degrees is a direction rotated by the angle of θ in the counter clockwise direction from 0 degrees around the point 164 within the plane 166.

FIG. 13A and FIG. 13B illustrate a coil spring that extends from an upper end 163 in a counter clockwise direction. Reference number 165 indicates a point on a surface of the coil spring. The point 165 is located at an outside position on the surface of the coil spring. Reference number 167 illustrates a virtual plane that contacts or intersects with the surface of the coil spring at the point 165. The directions for describing the orientation of the residual stress are as follows:

1) 0 degrees: 0 degrees is parallel with a direction along which the coil spring extends. 0 degrees extend from the point 165 toward the upper end 163.

2) θ degrees: θ degrees is a direction rotated by the angle of θ in the clockwise direction from 0 degrees around the point 165 within the plane 167.

FIG. 12B and FIG. 13B illustrate the angles of 45 degrees, 135 degrees, 225 degrees and 315 degrees, respectively.

When the coil spring is being used in an automobile suspension, a large tensile stress or load is generally applied along the direction of 135-315 degrees. Therefore, a large compressive residual stress oriented along the direction of 135-315 degrees contributes to improving the sag resistance and durability of the coil spring for the automobile suspension. It is known that a combination of a large residual stress oriented along the direction of 135-315 degrees and a relatively smaller residual stress oriented along the direction of 45-225 degrees improves the sag resistance and durability. However, even if the ratio of the residual stress oriented along the direction of 135-315 degrees divided by the residual stress oriented along the direction of 45-225 degrees is relatively high, sometimes a suitable sag resistance or durability still cannot be obtained. The inventors performed a substantial investigation concerning this phenomenon and determined that, even if the ratio is high at the surface of the coil spring, it is possible that the ratio may be reduced at an interior or depth position within the body of the coil spring. If the ratio is reduced or lower at the sub-surface or deeper positions and then the original surface or original surface layer is worn away during use of the coil spring, the ratio of the newly exposed surface is lower than the original surface. This finding demonstrated the importance of the ratio distribution along the depth direction of the steel wire forming the coil spring.

The new and useful coil spring disclosed herein preferably exhibits the following property: the ratio of the residual stress oriented along the direction of 135-315 degrees divided by the residual stress oriented along the direction of 45-225 degrees at the surface of the coil spring is preferably less than the ratio of the residual stress oriented along the direction of 135-315 degrees divided by the residual stress oriented along the direction of 45-225 degrees at a depth (perpendicular from the surface) of 0.2 mm of the steel wire forming the coil spring.

The new and useful coil spring exhibiting this property is very capable of handling the large tensile stress that is mainly applied along the direction of 135-315 degrees during use, even if the original surface is worn away; therefore, the sag resistance and durability of the coil spring for an automobile suspension are effectively improved.

BRIEF DESCRIPTION OF THE DRAWINGS

FIG. 1A provides a reference for understanding the compositions and manufacturing methods of the tested samples.

FIG. 1B shows the compositions of two types of tested steel wires.

FIG. 1C shows a first specification and properties of tested coil springs.

FIG. 1D shows a second specification and properties of tested coil springs.

FIG. 2 shows the results of a sag determination test.

FIG. 3 shows the results of a durability test.

FIG. 4 shows the results of a corrosion fatigue test.

FIG. 10 shows calculated ratios of residual stress oriented along the direction of 135-315 degrees divided by residual stress oriented along the direction of 45-225 degrees of exemplary and comparative steel coils.

FIG. 11 shows the relationships between the depth, the magnitude of the residual stress and the ratio of the residual stress oriented along the direction of 135-315 degrees divided by the residual stress oriented along the direction of 45-225 degrees.

DETAILED DESCRIPTION OF THE PREFERRED EMBODIMENT

Figure 5:
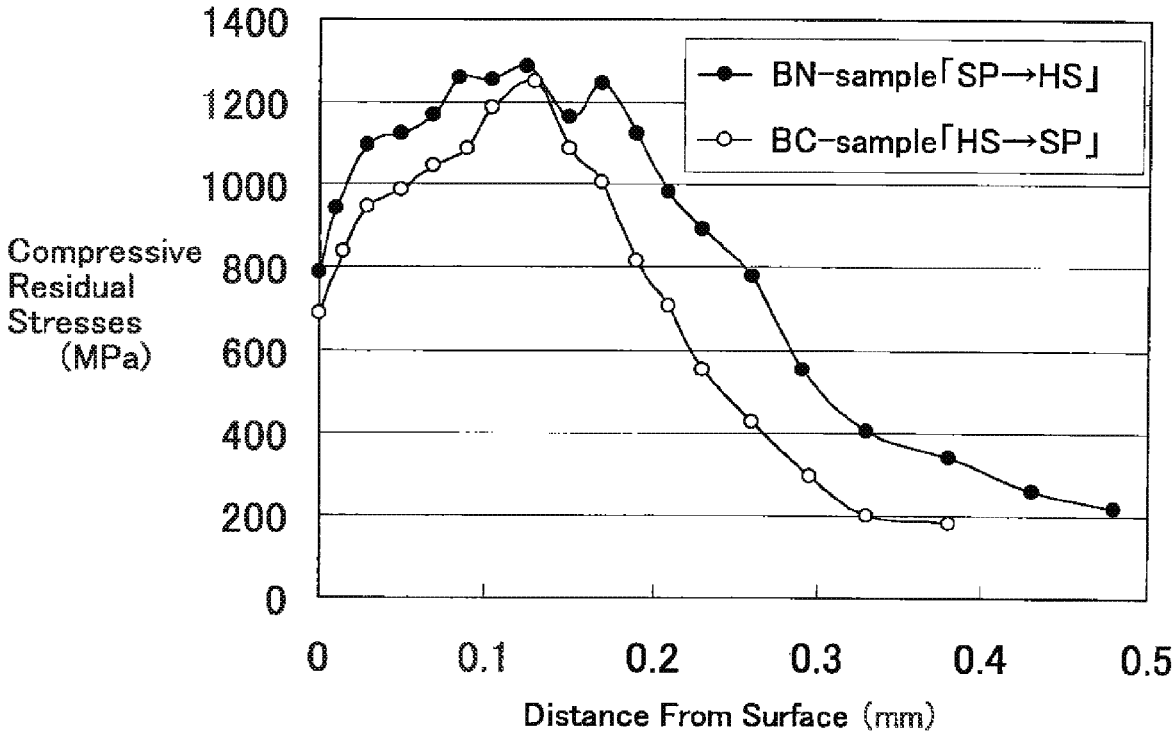
FIG. 5 shows the distribution of residual stress along the depth of exemplary and comparative steel coils.

A new method for manufacturing a new coil spring, e.g., for an automobile suspension preferably includes the following manufacturing steps performed in the following sequence. It should be noted that the below-mentioned steps (5) and (6) are optional and are not required to follow steps (1) to (4).

1) The steel wire is formed into a coil shape.

2) The coil-shaped steel wire is subjected to a heat treatment.

3) The heat-treated, coil-shaped steel wire is subjected to warm shot peening.

4) The coil-shaped steel wire is subjected to hot setting.

5) The coil-shaped steel wire is subjected to cold shot peening.

6) The coil-shaped steel wire is subjected to cold setting.

The manufacturing method of this embodiment can be practiced using any known steel wire that has been used in the manufacturing coil springs. However, the manufacturing method disclosed herein is particularly advantageous when the steel wire contains the following elements, in addition to iron. Furthermore, in addition to the below-mentioned elements, the steel may further include incidental elements and/or unavoidable impurities.

1) 0.35-0.55% carbon by mass, 2) 1.60-3.00% silicon by mass, 3) 0.20-1.50% manganese by mass, 4) 0.10-1.50% chromium by mass and at least one of the following elements:

5-1) 0.40-3.00% nickel by mass, 5-2) 0.05-0.50% molybdenum by mass and/or 5-3) 0.05-0.50% vanadium by mass.

Hereinbelow, for the sake of simplicity, the expression "percent by mass" will be abbreviated as "mass %".

When the steel wire has the above composition, coil springs manufactured according to the present methods have further improved sag resistance, durability and corrosion fatigue resistance properties.

Carbon is useful in strengthening the steel wire. When the amount of carbon is less than 0.35 mass %, the mechanical strength of the steel wire may not be suitable for certain aspects of the present teachings. When the amount of carbon is more than 0.55 mass %, it may become very difficult to form the steel wire into the shape of a coil for certain aspects of the present teachings.

Silicon also contributes to strengthening the coil spring, as well as to improving sag resistance. When the amount of silicon is less than 1.60 mass %, the mechanical strength of the steel wire may not be sufficient to obtain a satisfactory sag resistance for certain aspects of the present teachings. When the amount of silicon is more than 3.00 mass %, it may become very difficult to form the steel wire into the shape of the coil for certain aspects of the present teachings.

Manganese contributes to improving the hardenability of the steel and prevents the inclusion of any sulfur in the steel from causing undesirable effects. When the amount of manganese is less than 0.20 mass %, the above effects cannot be obtained for certain aspects of the present teachings. When the amount of manganese is more than 1.50 mass %, there is a risk of degrading the shaping properties of the steel for certain aspects of the present teachings.

Chromium also contributes to improving the hardenability of the steel and to improving the resistance against softening caused by tempering. When the amount of chromium is less than 0.10 mass %, the above effects cannot be obtained for certain aspects of the present teachings. When the amount of chromium is more than 1.50 mass %, carbon is inhibited from forming a homogeneous solution and the mechanical strength of the coil spring may be reduced for certain aspects of the present teachings.

Each of nickel, molybdenum and vanadium contributes to improving resistance against softening caused by tempering. When the amount of nickel is less than 0.40 mass %, the amount of molybdenum is less than 0.05 mass %, or the amount of vanadium is less than 0.05 mass %, the above effects may not be obtained for certain aspects of the present teachings. When the amount of nickel is more than 3.00 mass %, the amount of molybdenum is more than 0.50 mass %, or the amount of vanadium is more than 0.50 mass %, it may lead to a waste of resources and/or there is a risk of degrading the shaping properties of the steel for certain aspects of the present teachings.

The step of forming or shaping the steel wire into the coil shape may be performed according to a hot mode (above the re-crystallization temperature of the steel wire, such as 800 to 1000° C.), a warm mode (below the re-crystallization temperature of the steel wire such as 50 to 400° C.) or a cold mode (e.g., room temperature). Any type of forming/shaping process or apparatus may be utilized, such as a coiling machine. In addition, the coil may be formed by winding a steel wire around a core or rod.

The most appropriate heat treatment may be selected depending on the temperature at which the steel wire will be formed into the coil shape. When the steel wire is shaped into the coil according to the hot mode, quenching and tempering are preferably performed. The quenching temperature may be within the range of 800-1000° C. The tempering temperature may be within the range of 300-500° C. By performing quenching and tempering, the heat treated coil spring will acquire a suitable strength and toughness. When the steel wire is formed or shaped into the coil according to the warm or cold mode, low temperature annealing is preferably performed. The low temperature annealing may be performed for 20-60 minutes within the range of 300-500° C. By performing low temperature annealing, residual stresses developed during the coil-forming step can be released. Any type of known heat treatment method may be utilized without limitation.

In the warm shot peening step, steel balls having a diameter of 0.6-1.2 mm are shot against the surface of the heat treated coil spring within a speed range of 50-100 m/s. Warm shot peening may be performed under the condition that the heat treated coil spring is maintained within the temperature range of 150-400° C. This range is above room temperature and below the re-crystallization temperature of the coil spring. It is more preferable to maintain the coil spring within the temperature range of 250-350° C. The warm shot peening step may be performed, e.g., once or twice. The coverage thereof may be more than 80%. Any type of known warm shot peening method may be utilized without limitation. By performing the warm shot peening step, a large compressive residual stress develops at the surface of the coil spring, which contributes to improving the durability and the corrosion fatigue resistance properties of the coil spring. Further, by performing the warm shot peening step, it is possible to develop a large compressive residual stress at the surface of the coil spring without damaging the surface.

In the hot setting step, a compressive load that is larger than the maximum compressive load expected to be experienced by the coil spring during the actual use is applied to the coil spring as a manufacturing step. The hot setting is performed under the condition that the coil spring is maintained within a temperature range that is higher than room temperature and lower than the re-crystallization temperature of the coil spring. For example, the hot setting step may be performed under the condition that the coil spring is maintained within the temperature range of 150-400° C. while the compressive load is being applied thereto. The temperature of the coil spring during the hot setting step may be lower than the temperature utilized during the warm shot peening step. In this case, a heating step is not required after the warm shot peening step. Further, the hot setting may also be referred to as "warm setting". By performing the hot setting step, a permanent deformation and an anisotropic residual stress are developed in the coil spring. The ratio of the residual stress along the direction of 135-315 degrees divided by the residual stress along the direction of 45-225 degrees is increased. According to the method of the present embodiment, this ratio preferably increases from the outer surface towards the interior of the coil spring body. It is preferable that the hot setting step is performed so that residual shear strain $\gamma$ develops with a range of $10\times10^{-4}$-$40\times10^{-4}$. Performing the hot setting step within a temperature range that is higher than room temperature and lower than the re-crystallization temperature of the coil spring, such that the residual shear strain $\gamma$ remains within the range of $10\times10^{-4}$-$40\times10^{-4}$, does not undesirably influence the durability and/or corrosion fatigue resistance properties imparted by the warm shot peening step.

In the cold shot peening step, steel balls having a diameter of 0.1-1.0 mm are shot against the surface of the coil spring within a speed range of 50-100 m/s. The cold shot peening step may be performed under the condition that the coil spring is maintained at room temperature. The cold shot peening step may be performed once or twice. The coverage thereof may be more than 80%. Any type of known shot peening method may be utilized without limitation. It is preferable that larger steel balls are used in the warm shot peening step, and smaller steel balls are used in the cold shot peening step. By using larger steel balls in the warm shot peening step, a relatively large compressive residual stress develops at the surface, whereas using smaller steel balls in the cold shot peening step leads to an improved surface roughness. By performing the cold shot peening step, the durability and corrosion fatigue resistance properties of the coil spring are also further improved. The cold shot peening step does not undesirably influence the sag resistance imparted by the hot setting step.

In the cold setting step, a compressive load that is larger than the maximum compressive load expected to be experienced by the coil spring during the actual use is applied to the coil spring as a manufacturing step. The cold setting step is performed under the condition that the coil spring is maintained at room temperature while the compressive load is being applied thereto. It is preferable that the cold setting step is performed so that residual shear strain $\gamma$ remains within the range of $1\times10^{-4}$-$10\times10^{-4}$. Performing the cold setting step at room temperature at a magnitude, such that the residual shear strain $\gamma$ remains within the range of $1\times10^{-4}$-$10\times10^{-4}$, does not undesirably influence the durability and corrosion fatigue resistance properties imparted by the warm shot peening step and the cold shot peening step.

The above cold shot peening step and/or the cold setting step may be omitted. Further, one or more additional step(s) or process(es) optionally may be added. For instance, the coil spring may be cooled with water or another liquid after the hot setting step.

According to the method of this embodiment, the hardness of the manufactured coil spring is preferably within the range of Rockwell hardness HRC 50-56. The range of HRC 51-55 is more preferable for a coil spring to be used in an automobile suspension. The present embodiment covers the appropriate range.

Representative, non-limiting examples of the present teachings will now be described in further detail with reference to the attached drawings. This detailed description is merely intended to teach a person of skill in the art further details for practicing preferred aspects of the present teachings and is not intended to limit the scope of the invention. Furthermore, each of the additional features and teachings disclosed below may be utilized separately or in conjunction with other features and teachings to provide improved coil springs, e.g., for an automobile suspension, as well as methods for manufacturing the same.

Moreover, combinations of features and steps disclosed in the following detail description may not be necessary to practice the invention in the broadest sense, and are instead taught merely to particularly describe representative examples of the invention. Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

EXAMPLES

Two types of steel wire A and B having the different compositions shown in FIG. 1B were used for testing purposes. Two types of coil springs for an automobile suspension were manufactured using each of the respective steel wires. One set of coil springs (AN-sample and BN-sample) was manufactured according to the new method disclosed herein and the other set of coil springs (AC-sample and BC-sample) was manufactured using the above-described conventional method. FIG. 1A provides a convenient reference for understanding the composition and manufacturing method of the four coil springs. Further, the specifications and properties of the coil springs of the AN-sample and AC-sample are shown in FIG. 1C, and the specifications and properties of the coil springs of the BN-sample and BC-sample are shown in FIG. 1D.

Steel wire A has the composition shown in FIG. 1B. The remainder of the aforementioned composition is iron (Fe), and incidental elements and/or unavoidable impurities. In the present example, C, Si, Mn, P, S, Ni, Cr, V and/or Fe were mixed in powder form according to the mass ratios shown in FIG. 1B; the mixture was then melted, divided into blocks by rolling, and stretched into a wire or rod shape by further rolling. The AN-sample and AC-sample were manufactured from the wire A prepared in this manner.

Steel wire B has the composition shown in FIG. 1B. The remainder of the aforementioned composition is iron (Fe), and incidental elements and/or unavoidable impurities. In the present example, C, Si, Mn, P, S, Ni, Cu, Cr, Mo, V, Ti, B and/or Fe were mixed in powder form according to the mass ratios shown in FIG. 1B; the mixture was then melted, divided into blocks by rolling, and stretched into a wire or rod shape by further rolling. The BN-sample and BC-sample were manufactured from the wire B prepared in this manner.

(Manufacturing Method for the AN-Sample)

The AN-sample was manufactured according to the following sequence of steps:

(1) Steel wire A was subjected to an oil quenching and tempering process.

(2) Steel wire A was formed into a coil shape according the above-described cold mode process.

(3) Steel wire A was subjected to low temperature annealing.

(4) Steel wire A was subjected to warm shot peening.

(5) Steel wire A was subjected to hot setting.

(6) Steel wire A was cooled with water.

(7) Steel wire A was subjected to cold shot peening.

(8) Steel wire A was subjected to cold setting.

The conditions of the manufacturing steps were as follows:

(3) The low temperature annealing step was performed for 30 minutes at 350° C.

(4) The warm shot peening step was performed using steel balls having a diameter of 1.2 mm while maintaining the steel wire at 300° C.

(5) The hot setting step was performed while the steel wire was maintained at 200° C. until the free length of the coil spring under no load was shortened by 21 mm, which resulted in a residual shear strain $\gamma$ of $13.7\times10^{-4}$.

(7) The cold shot peening step was performed using steel balls having a diameter of 0.8 mm.

(8) The cold setting step was performed until the free length of the coil spring under no load was shortened by 3 mm, which resulted in a residual shear strain $\gamma$ of $2\times10^{-4}$.

(Manufacturing Method for the AC-Sample)

The AC-sample was manufactured according to the following sequence of steps:

(1) Steel wire A was subjected to an oil quenching and tempering process.
(2) Steel wire A was formed into the coil shape according to the above-described cold mode process.
(3) Steel wire A was subjected to low temperature annealing.
(5c) Steel wire A was subjected to hot setting.
(4c) Steel wire A was subjected to warm shot peening.
(6) Steel wire A was cooled with water.
(7) Steel wire A was subjected to cold shot peening.
(8) Steel wire A was subjected to the cold setting.
The sequence of steps (5c) (hot setting) and (4c) (warm shot peening) was reversed as compared to the manufacturing method for the AN-sample. The method of manufacturing the AC-sample thus corresponds to a conventional method.

The conditions of the manufacturing steps were as follows:
(5c) The hot setting step was performed while the steel wire was maintained at 300° C.
(4c) During the warm shot peening step, the steel wire was maintained at 200° C.
The other conditions were the same as those for manufacturing the AN-sample.

The AN-sample and AC-sample manufactured in this manner exhibited the specifications and properties shown in FIG. 1C. The hardness of the AN-sample and AC-sample was HRC 53.

(Manufacturing Method for the BN-Sample)

The BN-sample was manufactured according to the following sequence of steps:
(1) Steel wire B was heated to 990° C.
(2) Steel wire B was formed into the coil shape according to the above-described hot mode process.
(3) Steel wire B was subjected to oil quenching.
(4) Steel wire B was subjected to tempering.
(5) Steel wire B was subjected to warm shot peening.
(6) Steel wire B was subjected to hot setting.
(7) Steel wire B was cooled with water.
(8) Steel wire B was subjected to cold shot peening.
(9) Steel wire B was subjected to cold setting.

The conditions of the manufacturing steps were as follows:
(4) The tempering process was performed at 370° C.
(5) The warm shot peening step was performed using steel balls having a diameter of 1.0 mm while maintaining the steel wire at 350° C.
(6) The hot setting step was performed while the steel wire was maintained at 180° C. The hot setting was performed until the free length of the coil spring under no load was shortened by 36 mm, which resulted in a residual shear strain $\gamma$ of $26.0\times10^{-4}$.
(8) The cold shot peening step was performed using steel balls having a diameter of 0.6 mm.
(9) The cold setting step was performed until the free length of the coil spring under no load was shortened by 4 mm, which resulted in a residual shear strain $\gamma$ of $2\times10^{-4}$.

(Manufacturing Method for the BC-Sample)

The BC-sample was manufactured according to the following sequence of steps:
(1) Steel wire B was heated to 990° C.
(2) Steel wire B was formed into the coil shape according to the above-described hot mode process.
(3) Steel wire B was subjected to oil quenching.
(4) Steel wire B was subjected to tempering.
(6c) Steel wire B was subjected to hot setting.
(5c) Steel wire B was subjected to warm shot peening.
(7) Steel wire B was cooled with water.
(8) Steel wire B was subjected to cold shot peening.
(9) Steel wire B was subjected to cold setting.

The sequence of steps (6c) (hot setting) and (5c) (warm shot peening) was reversed as compared to the manufacturing sequence for the BN-sample. The method of manufacturing the BC-sample thus corresponds to a conventional method.

The conditions of the manufacturing steps were as follows:
(6c) The hot setting step was performed while the steel wire was maintained at 330° C.
(5c) During the warm shot peening step, the steel wire was maintained at 230° C.
The other conditions were the same as those for manufacturing the BN-sample.

The BN-sample and BC-sample manufactured in this manner exhibited the specifications and properties shown in FIG. 1D. The hardness of the BN-sample and AC-sample was HRC 54.

(Sag Determination Test)

Two pieces of the AN-sample and two pieces of the AC-sample were tested. The AN-sample and the AC-sample were designed to be used under a maximum load of 5472 N. Therefore, the maximum load of 5472 N was applied to compress each of tested coil springs, and the compressed length of the shortened coil springs was securely fixed. The shortened coil springs were maintained under compression for 96 hours at 80° C. After 96 hours, the coil springs were released and the free length of each of the coil springs was measured. The free length of each of the coil springs was reduced in each case and the magnitudes of the reduction of the free lengths were calculated. The reduced lengths were converted into units of shear strain $\gamma$. FIG. 2 shows the magnitudes of the changes of residual shear strain $\gamma$ (amount of sag) caused by the test. The order of magnitude of the indicated values is $10^{-4}$. In this text, the smaller the value, the more improved the sag resistance is, wherein larger values may indicate an unsatisfactory sag resistance. Both of the AN-samples exhibited better sag resistance than the two AC-samples. Thus, it was determined that the AN-samples are capable of maintaining the strain-stress relationship at a relatively constant level for a longer period of time than the AC-samples.

(Durability Test)

Two pieces of the BN-sample and two pieces of the BC-sample were tested. A cyclically-changing (oscillating) load was applied to each of tested coil springs, and the number of oscillation cycles until the coil spring broke was measured. The magnitude change of the applied stress or load fell within the range of 735+550 MPa to 735−550 MPa. FIG. 3 shows the number of cycles until each coil spring broke. The order of magnitude of the values is $10^4$. The larger the value, the greater the durability is, wherein smaller values generally indicate a shorter service life. Both of the BN-samples exhibited better durability than the BC-samples. In fact, the BN-samples exhibited nearly twice the service life of the BC-samples.

(Corrosion Fatigue Test)

Two pieces of the BN-sample and two pieces of the BC-sample were tested. The surfaces of each the tested coil springs were provided with a protective coating in advance. The test was then performed according the following sequence of steps, each of which will be further described in the following paragraph.
1) Chipping,
2) Corrosion promoting process (repeated 5 times),
3) Application of cyclic stress (3,000 cycles),
4) Repeating steps 2) and 3) 11 times (i.e., steps 2) and 3) were performed a total of 12 times) and
5) Application of cyclic stress until the coil spring broke.

The chipping step 1) was performed by dropping each of tested coil springs onto a bed of crushed rock. The dropped coil springs fell onto the crushed rock bed with sufficient force to damage the protective coating. This process was repeated 4 times. The corrosion promoting process of step 2) was performed by spraying saltwater (salt concentration: 5%) onto the coil spring for 6 hours; the coil spring was then maintained under dry conditions (relative humidity 20% at 60° C.) for 6 hours, followed by maintaining the coil spring under humid conditions (relative humidity 95% at 50° C.) for 12 hours. The corrosion promoting process was repeated 5 times. The application of cyclic stress according to step 3) was performed using the same process as in the above-described durability testing. That is, the cyclically-changing (oscillating) stress or load was applied to the coil spring within the range of 735+550 MPa to 735−550 MPa. 3,000 cycles were performed. The set of the corrosion promoting step 2) performed 5 times and the cyclic stress application step 3) performed for 3,000 cycles was repeated 12 times in total. Thereafter, the coil springs were subjected to the application of cyclically-changing stress, as was described above, until each coil spring broke. FIG. 4 shows the number of cycles performed on each of the coil springs until the respective coil spring broke. The order of magnitude is $10^4$. The larger the value, the higher the corrosion fatigue resistance is, wherein smaller values may indicate relatively weak corrosion fatigue resistance properties. Both of the BN-samples exhibited better corrosion fatigue resistance properties than the BC-samples.

(Measuring Residual Stress)

The residual stress of the BN-sample and BC-sample was measured. In order to recognize the difference clearly, cold shot peening and cold setting were omitted in the process of manufacturing the tested coil springs. The other processes were same as the BN-sample and BC-sample used in the above-described service life (durability) test.

Figure 12A:
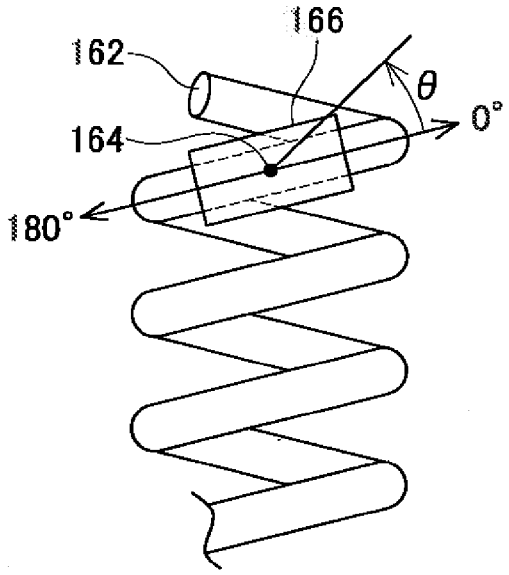
FIG. 12A shows an upper portion of a spring that extends from an upper end in a clockwise direction.
Figure 12B:
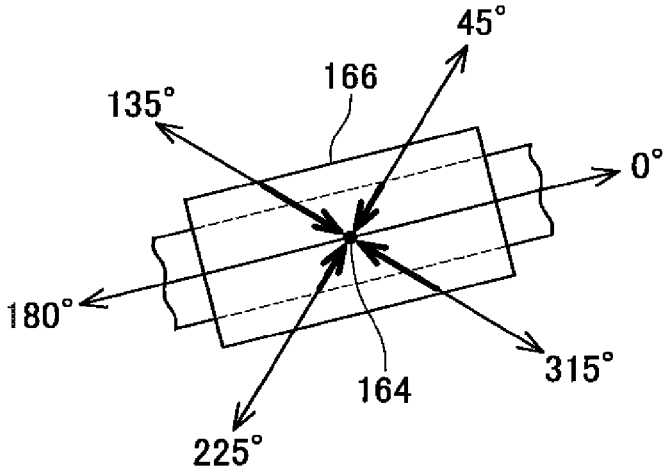
FIG. 12B shows an enlarged side view of the coil spring and the directions for describing the orientation of the residual stress.
Figure 12C:
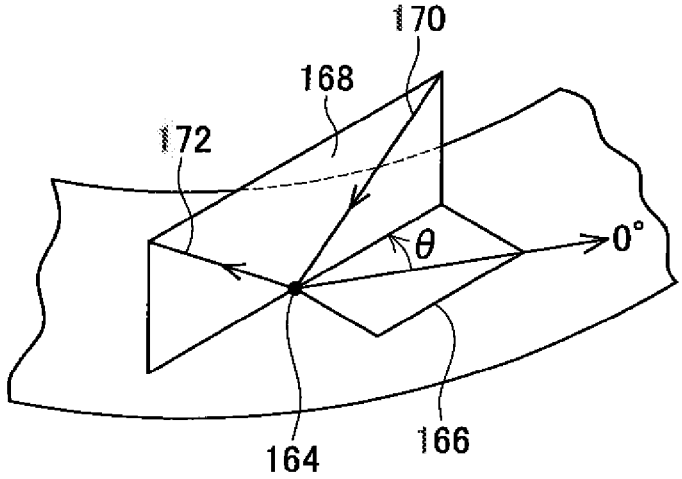
FIG. 12C explains a method for measuring residual stress using X-ray diffraction.
Figure 13A:
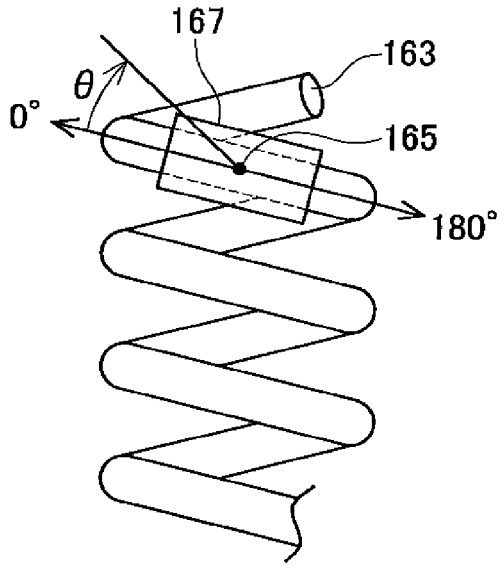
FIG. 13A shows an upper portion of a spring that extends from an upper end in a counter clockwise direction.
Figure 13B:
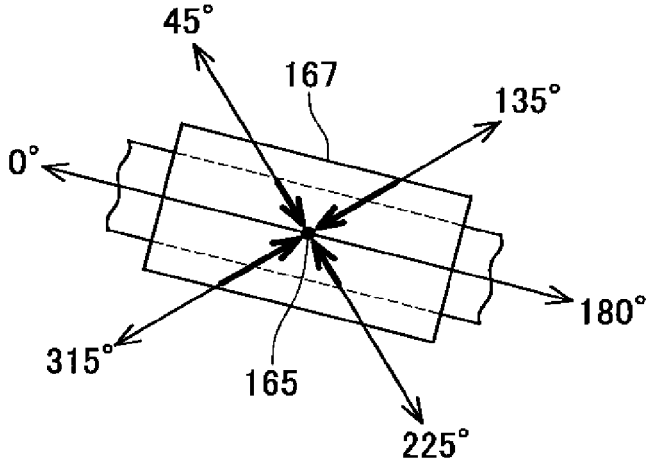
FIG. 13B shows an enlarged side view of the coil spring and the directions for describing the orientation of the residual stress.
Figure 13C:
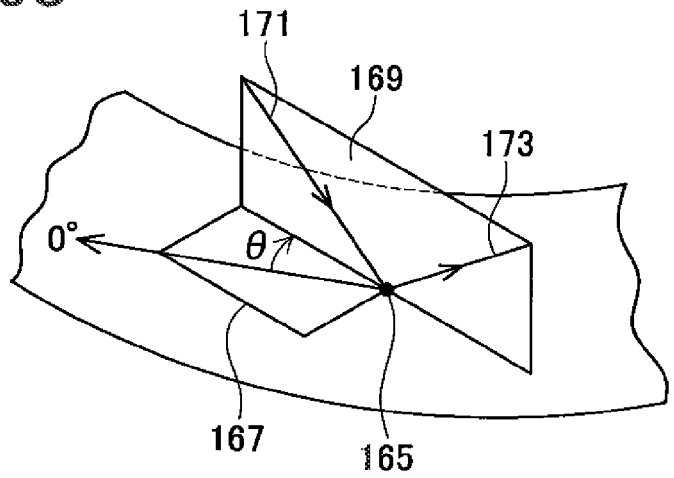
FIG. 13C explains a method for measuring residual stress using X-ray diffraction.

The magnitude of the residual stress was measured according to an X-ray residual stress measurement technique (X-ray diffraction). For a complete understanding, the following description should be read together with the description concerning residual stress provided above in the Summary section. The X-ray residual stress measuring technique utilized in the present embodiment will be further explained with reference to FIG. 12C. Reference numeral 164 indicates a point of measuring the magnitude of the residual stress. Reference 166 indicates a virtual plane that contacts or intersects with the surface of the coil spring at the measuring point 164. Reference 168 indicates another virtual plane that is perpendicular to the plane 166. The plane 168 passes through the measuring point 164. The plane 168 is rotated in a counter clockwise direction around the measuring point 164 within the plane 166. The magnitude of residual stress in the θ direction was measured by observing the diffracted X-rays 172. The reference number 170 indicates the X-rays irradiated towards the measuring point 164. X-rays 170 are diffracted along the θ plane(s) 172. In the measurement, θ was set to be 0, 45, 90, 135, 180, 225, 270 and 315 degrees. Therefore, the magnitudes of the residual stress at 0, 45, 90, 135, 180, 225, 270 and 315 degrees were respectively measured. As shown in FIG. 13C, when the coil spring extends in the counter clockwise direction, the angle θ was measured in the clockwise direction.

In the present X-ray residual stress measurement technique, not only the magnitude of the residual stress at the surface was measured, but also the magnitudes of the residual stresses at deeper (interior) positions were measured. In the present embodiment, the magnitudes of the residual stresses at the surface, at a depth of 0.1 mm, at a depth of 0.2 mm and at a depth of 0.3 mm were measured. The magnitudes of the residual stress at each depth were measured at the angle θ of 0, 45, 90, 135, 180, 225, 270 and 315 degrees.

FIG. 5 shows the relationship between the depth (distance from the surface) and the measured magnitude of the residual stress. The magnitude of the residual stress in FIG. 5 is an average measured at the angles θ of 0, 45, 90, 135, 180, 225, 270 and 315 degrees. The unit of depth is millimeters as measured vertically or perpendicularly from the surface of the coil spring, and the unit of the measured stress is MPa.

The black circles indicate the measurement results for the BN-sample, whereas the white circles indicate the measurement results for the BC-sample. As indicated by the black circles, the coil spring manufactured according to the new method disclosed herein exhibits a larger residual stress than the coil spring manufactured according to the conventional method at all depths from the surface of the coil spring.

Figure 6:
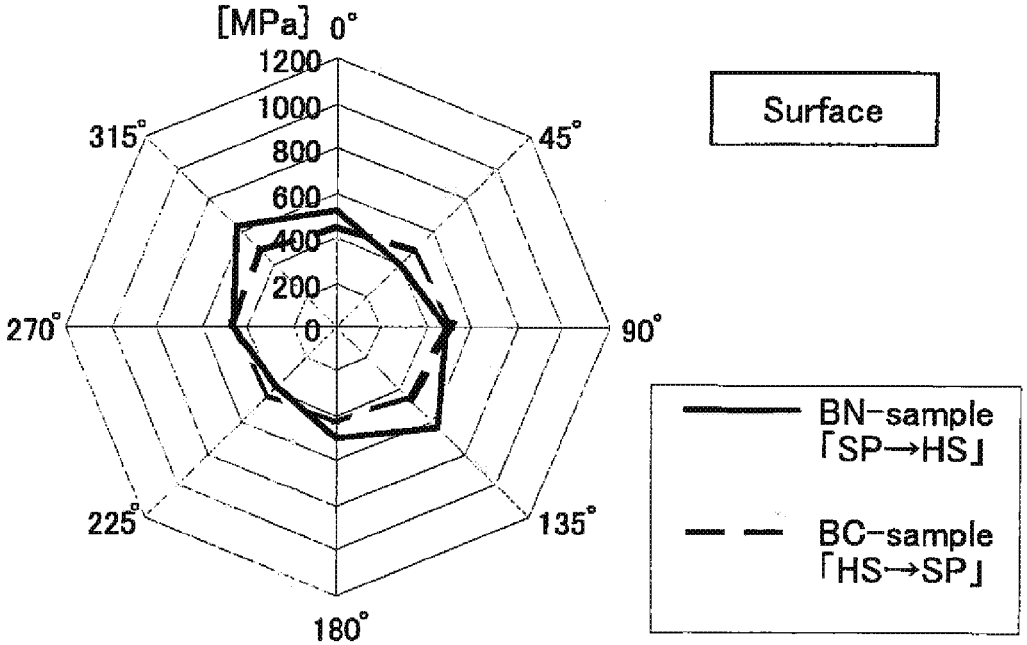
FIG. 6 shows the relationship between residual stress and it orientation at the surface of exemplary and comparative steel coils.

FIG. 6 illustrates the residual stress orientation measured at the surface. The solid line indicates the measurement results for the BN-sample, whereas the dashed line indicates the measurement results for the BC-sample. The solid line clearly indicates a stronger anisotropy than the dashed line. The coil spring manufactured according to the present method thus exhibits a stronger anisotropy than the coil spring manufactured according to the conventional method.

The coil spring manufactured according to the present method exhibits a larger residual stress along the direction or axis extending from 135 to 315 degrees than the coil spring manufactured according to the conventional method. When the coil spring is in use, large tensile stress is applied along the direction of 135 and 315 degrees. Larger residual compressive stresses along the direction of 135 and 315 degrees act so as to cancel or offset the large tensile stress applied along the direction of 135 and 315 degrees during use. The larger residual compressive stresses along the direction of 135 and 315 degrees thus contribute to improving the sag resistance and the durability of the coil spring.

Figure 7:
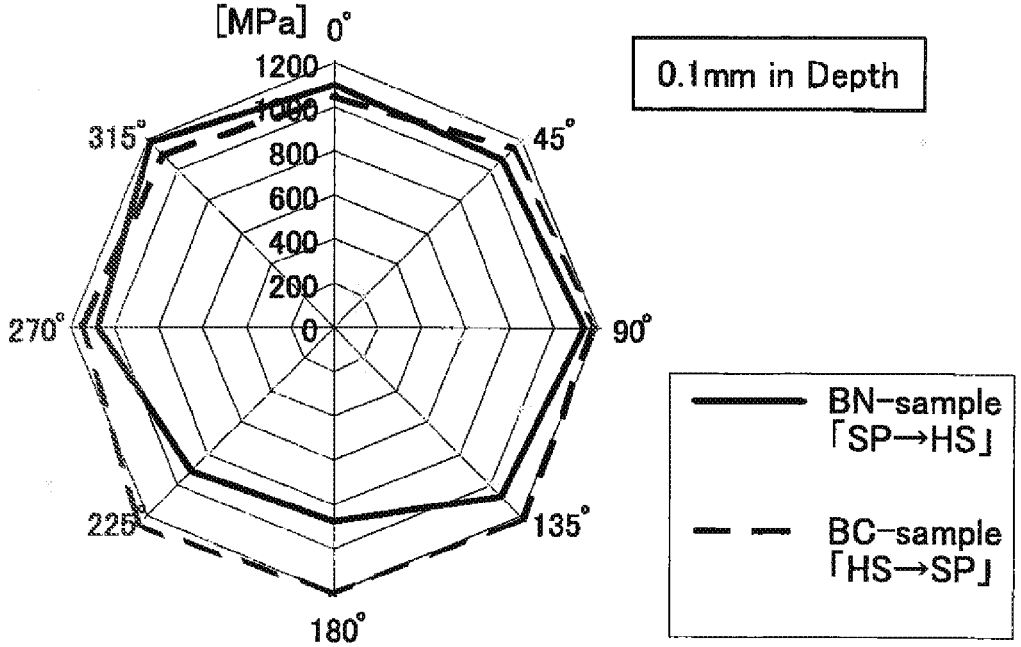
FIG. 7 shows the relationship between residual stress and its orientation at a depth of 0.1 mm of exemplary and comparative steel coils.
Figure 8:
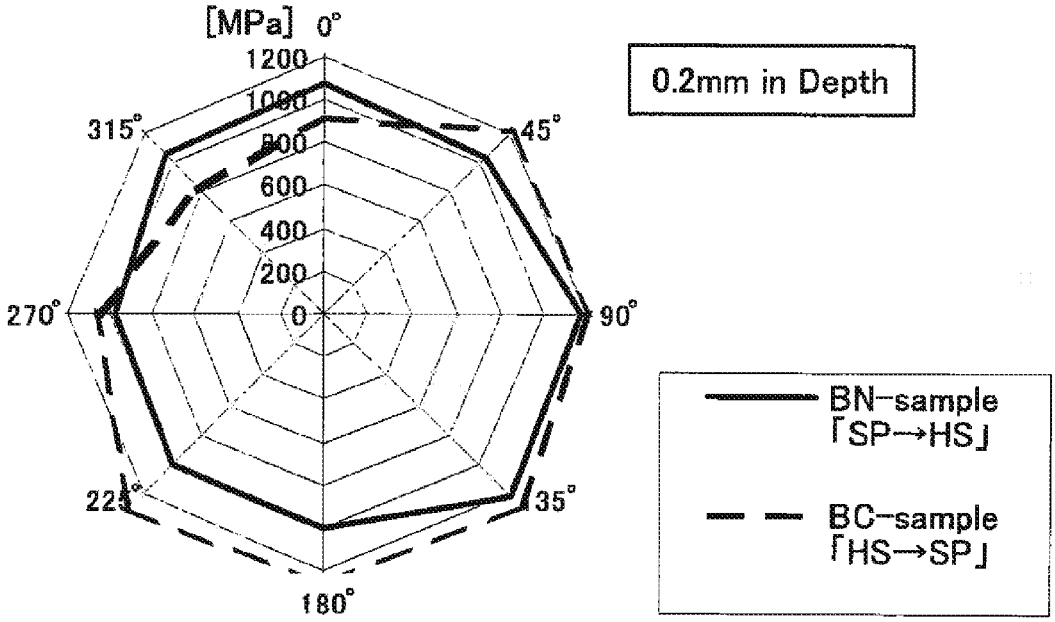
FIG. 8 shows the relationship between residual stress and its orientation at a depth of 0.2 mm of exemplary and comparative steel coils.
Figure 9:
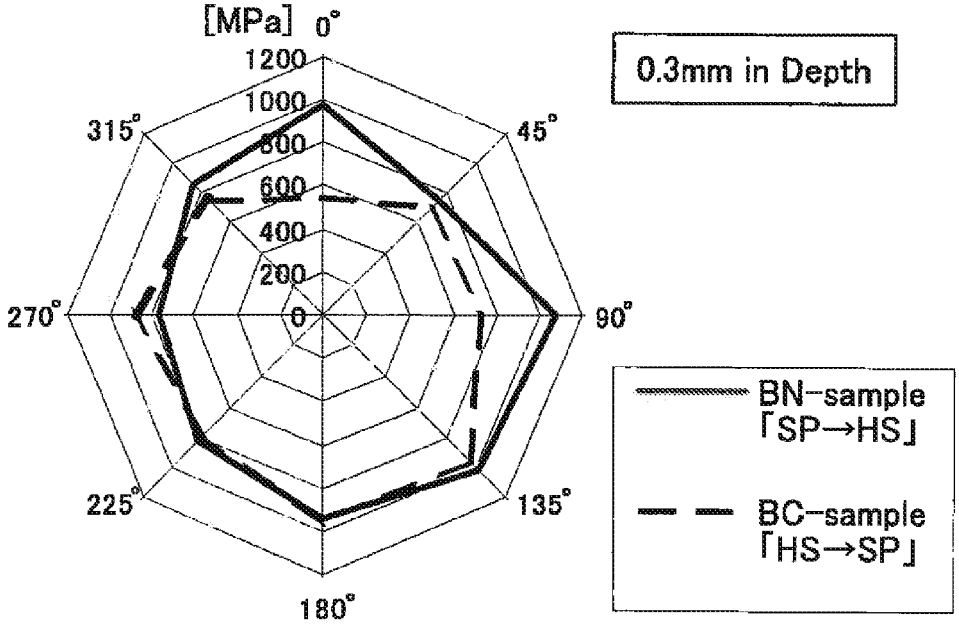
FIG. 9 shows the relationship between residual stress and its orientation at a depth of 0.3 mm of exemplary and comparative steel coils.

FIG. 7 illustrates the residual stress orientation measured at the depth of 0.1 mm. FIG. 8 illustrates the residual stress orientation measured at the depth of 0.2 mm. FIG. 9 illustrates the residual stress orientation measured at the depth of 0.3 mm. At every depth, the coil spring manufactured according to the present method exhibits a stronger residual stress along the direction of 135 and 315 degrees. According to this embodiment, larger residual stresses along the direction of 135 and 315 degrees, which contribute to improving the sag resistance and the durability of the coil spring, can be obtained at every depth.

FIG. 10 shows a ratio of (residual stress at 135 degrees+residual stress at 315 degrees) divided by (residual stress at 45 degrees+residual stress at 225 degrees). The coil spring manufactured according to the present method exhibits a stronger anisotropy than the coil spring manufactured according to the conventional method at every depth.

Another type of coil spring was manufactured from the steel wire B. The BN1-sample and BN2-sample shown in FIG. 11 were manufactured according to the new method disclosed herein. The BC1-sample and BC2-sample shown in FIG. 11 were manufactured according to the above-described conventional method. The manufacturing sequence and conditions were the same as the BN-sample and BC-sample, except that the cold shot peening and the cold setting steps were omitted.

FIG. 11 indicates the orientation of the residual stress, the magnitude of the measured residual stress and the depth of the measured point. For instance, 607 MPa was observed at the surface at 135 degrees, and 648 MPa was observed at the surface at 315 degrees. FIG. 11 also indicates the ratio of (residual stress at 135 degrees+residual stress at 315 degrees) divided by (residual stress at 45 degrees+residual stress at 225 degrees).

According to the BN1 and BN2 samples, the ratio at the depth of 0.2 mm is larger than the ratio at the surface. The ratio of the BN1 and BN2 samples at the depth of 0.2 mm is larger than 1.0. On the other hand, the ratio of the BC1 and BC2 samples at the depth of 0.2 mm is smaller than 1.0. BN1 and BN2 samples manufactured according to the present method exhibit improved sag resistance and durability of the coil spring due to the large residual compressive stress at 135 and 315 degrees.

Further, the residual stress at 135 and 315 degrees at the depth of 0.2 mm of the BN1 and BN2 samples is greater than 950 MPa. On the other hand, the residual stress at 135 and 315 degrees at the depth of 0.2 mm of the BC1 and BC2 samples is within a range of 700-750 MPa. The BN1 and BN2 samples manufactured according to the present method exhibit larger residual compressive stress at 135 and 315 degrees than the BC1 and BC2 samples manufactured according to the conventional method. The BN1 and BN2 samples manufactured according to the present method exhibit improved sag resistance and durability of the coil spring due to the large residual compressive stress at 135 and 315 degrees.

Additional teachings relevant to, and advantageously combinable with the present teachings, are found in, e.g., commonly-owned U.S. Pat. Nos. 4,448,617, 4,544,406, 5,897,717, 6,017,641, 6,027,577, 6,193,816, 6,375,174, 6,543,757, 6,550,301, 6,616,131, 6,648,996, 6,712,346, 6,779,564, 6,836,964, 7,407,555, 7,699,943, 7,776,440, and U.S. Patent Publication Numbers 2009/0079246, 2011/0074076, 2011/0074077 and 2011/0074078, the contents of all of which are hereby incorporated by reference as if fully set forth herein.

The invention claimed is:

1. A method for manufacturing a coil spring for an automobile suspension that satisfies the following properties:

a ratio of a compressive residual stress at a depth of 0.2 mm is larger than the ratio of the compressive residual stress at the surface of a coil, wherein the ratio of the compressive residual stress is obtained according to the following formula:

(compressive residual stress at 135 degrees+compressive residual stress at 315 degrees)/(compressive residual stress at 45 degrees+compressive residual stress at 225 degrees), and the degree is measured relative to a 0 degree plane that extends in parallel with a direction along which the coil spring extends, the method comprising:

forming an iron-containing, metallic material into a coil shape;

then subjecting the material to a heat treatment;

then subjecting the heat-treated material to warm shot peening by shooting first steel balls against the surface of the material;

then subjecting the warm shot peened material to hot setting immediately after the warm shot peening without subjecting the warm shot peened material to any other intervening heat treatment; and then subjecting the hot set material to cold shot peening, wherein second steel balls are shot against the surface of the material, the first steel balls having a diameter that is larger than the diameter of the second steel balls.

2. The method as in claim 1, wherein the material comprises, in terms of mass percentage:

0.35 to 0.55% C;

1.60 to 3.00% Si;

0.20 to 1.50% Mn;

0.10 to 1.50% Cr, and at least one element selected from the group consisting of:

0.40 to 3.00% Ni, 0.05 to 0.50% Mo, and 0.05 to 0.50% V, the balance being Fe, and unavoidable impurities.

3. The method as in claim 2, wherein the warm shot peening step is performed while the material is maintained within a temperature range of 150-400° C.

4. The method as in claim 3, wherein the warm shot peening step is performed while the material is maintained within a temperature range of 250-350° C.

5. The method as in claim 4, wherein the hot setting step is performed while the material is maintained within a temperature range of 150-400° C.

6. The method as in claim 5, wherein the temperature of the material during the hot setting step is lower than the temperature of the material during the warm shot peening step.

7. The method as in claim 6, wherein the heat treatment step comprises heating the iron-containing, metallic material to a temperature of between 800-1000° C.

8. The method as in claim 7, wherein the hot setting step comprises compressing the coil spring, fixing the coil spring in the compressed state and subjecting the compressed coil spring to an elevated temperature.

9. The method as in claim 8, further comprising subjecting the cold shot peened material to cold setting by compressing the coil spring and maintaining the coil spring in the compressed state at about room temperature.

10. The method as in claim 9, wherein the coil spring has a residual shear strain $\gamma$ within a range of $1\times10^{-4}$-$10\times10^{-4}$ after the cold shot peening step.

11. The method as in claim 1, wherein the warm shot peening step is performed while the material is maintained within a temperature range of 150-400° C.

12. The method as in claim 1, wherein the hot setting step is performed while the material is maintained in a compressed state and within a temperature range of 150-400° C.

13. The method as in claim 1, wherein the temperature of the material during the hot setting step is lower than the temperature of the material during the warm shot peening step.

14. The method as in claim 1, further comprising subjecting the cold shot peened material to cold setting by compressing the coil spring and maintaining the coil spring in the compressed state at about room temperature.

15. The method as in claim 14, wherein the coil spring has a residual shear strain $\gamma$ within a range of $1\times10^{-4}$-$10\times10^{-4}$ after the cold shot peening step.

16. The method as in claim 15, wherein the temperature of the material during the hot setting step is lower than the temperature of the material during the warm shot peening step.

17. The method as in claim 1, wherein the heat treatment step comprises heating the iron-containing, metallic material to a temperature of between 800-1000° C.

18. A coil spring produced according to a process comprising:

forming an iron-containing, metallic material into a coil shape;

then subjecting the material to a heat treatment that comprises heating the iron-containing, metallic material to a temperature of between 800-1000° C.;

then subjecting the heat-treated material to warm shot peening while the material is maintained within a temperature range of 250-350° C., the warm shot peening step being performed by shooting first steel balls against the surface of the material;

then subjecting the warm shot peened material to hot setting while the material is maintained within a temperature range of 150-400° C., with the proviso that the temperature of the material during the hot setting step is lower than the temperature of the material during the warm shot peening step, wherein the hot setting step comprises compressing the coil spring, fixing the coil spring in the compressed state and subjecting the compressed coil spring to an elevated temperature;

then subjecting the hot set material to cold shot peening, wherein second steel balls are shot against the surface of the material, the first steel balls having a diameter that is larger than the diameter of the second steel balls; and then subjecting the cold shot peened material to cold setting by compressing the coil spring and maintaining the coil spring in the compressed state at about room temperature, wherein the coil spring has a residual shear strain $\gamma$ within a range of $1\times10^{-4}$-$10\times10^{-4}$ after the cold shot peening step, and wherein the iron-containing, metallic material comprises, in terms of mass percentage:

0.35 to 0.55% C;

1.60 to 3.00% Si;

0.20 to 1.50% Mn;

0.10 to 1.50% Cr, and at least one element selected from the group consisting of:

0.40 to 3.00% Ni, 0.05 to 0.50% Mo, and 0.05 to 0.50% V, the balance being Fe, and unavoidable impurities.

19. The coil spring as in claim 18, wherein the coil spring satisfies the following properties:

a ratio of a compressive residual stress at a depth of 0.2 mm is larger than the ratio of the compressive residual stress at the surface of a coil, wherein the ratio of the compressive residual stress is obtained according to the following formula:

(compressive residual stress at 135 degrees+compressive residual stress at 315 degrees)/(compressive residual stress at 45 degrees+compressive residual stress at 225 degrees), and the degree is measured relative to a 0 degree plane that extends in parallel with a direction along which the coil spring extends.

20. The coil spring as in claim 19, wherein the compressive residual stress at 135 degrees and 315 degrees at the depth of 0.2 mm is within a range of 800 to 1200 MPa.

21. The coil spring as in claim 20, wherein the coil spring exhibits a hardness within a range of HRC 50 to 56.

* * * * *